US006902076B2

(12) United States Patent
Bauer et al.

(10) Patent No.: US 6,902,076 B2
(45) Date of Patent: Jun. 7, 2005

(54) BOTTLE AND BOTTLE CLOSURE ASSEMBLY

(75) Inventors: Richard W. Bauer, Webster, NY (US); Van W. Huston, Webster, NY (US); Theodore K. Ricks, Rochester, NY (US); Thomas D. Jensen, Rochester, NY (US); John W. King, Lakeville, NY (US); Malinda L. McFeaters, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 161 days.

(21) Appl. No.: 10/080,118

(22) Filed: Feb. 21, 2002

(65) Prior Publication Data

US 2003/0155321 A1 Aug. 21, 2003

(51) Int. Cl.[7] ..... B65D 39/00
(52) U.S. Cl. ..... 215/253; 220/229
(58) Field of Search ..... 215/253, 303, 215/247–249, 250, 226, DIG. 3, 257; 222/490, 494, 80, 83.5, 541.1–541.8; 220/229, 258.3–258.5, 255.1, 257.1, 258.1, 277–279

(56) References Cited

U.S. PATENT DOCUMENTS

| | | | | | |
|---|---|---|---|---|---|
| 4,770,305 | A | * | 9/1988 | Su | 215/250 |
| 4,993,569 | A | * | 2/1991 | Osip et al. | 215/226 |
| 5,188,628 | A | * | 2/1993 | Rani et al. | 604/405 |
| 6,213,324 | B1 | | 4/2001 | Schwallie et al. | |
| 6,527,110 | B2 | * | 3/2003 | Moscovitz | 206/222 |
| 2003/0042257 | A1 | * | 3/2003 | Uchyama | |

FOREIGN PATENT DOCUMENTS

| | | |
|---|---|---|
| EP | 0 947 441 | 10/1999 |

* cited by examiner

*Primary Examiner*—Lien M. Ngo
(74) *Attorney, Agent, or Firm*—Frank Pincelli

(57) ABSTRACT

A bottle and bottle closure assembly for draining a solution contained within a bottle, the bottle closure assembly. The bottle has a base section, a body portion extending from the base and terminating into a neck portion having an outlet through which the solution may pass. A seal is secured to the neck portion so as to cover the opening such that the seal will retain solution within the bottle. A cap member has rupture members designed to assist in the rupture of the seal.

26 Claims, 11 Drawing Sheets

BOTTLE AND BOTTLE CLOSURE ASSEMBLY

FIELD OF THE INVENTION

The present invention is directed to a bottle closure assembly and bottle for containing a processing solution for placement in a photographic processing apparatus.

BACKGROUND OF THE INVENTION

Certain chemical processing solutions used in photographic processing apparatus typically must be mixed with other chemical solutions or with water prior to their use. In order to assure product freshness it is often important for the mixing to be carried out just before use. This is particularly the case with photographic processing solutions used in photographic processors. Customer requirements for easier handling of these photochemical solutions, with less exposure to the chemicals, has generated the need for a closure which does not need to be removed or replaced in order to dispense the photographic processing solution. In addition, seal integrity, customer handling, and recyclability requirements have resulted in the need for a closure molded from high density polyethylene (HDPE) resin which can seal the bottle and be opened simply by inserting the bottle into processing apparatus having a probe for opening of the closure for allowing the processing solution to freely flow out of the bottle/container. At the present time, each photochemical processing solution to be mixed is stored in a separate plastic container/bottle closed by a liquid tight seal. The photochemical manufacturing community currently utilizes various closure methods for sealing bottles filled with photographic chemicals. In one method a foam/cardboard seal is inserted inside the bottle cap. This requires that the cap be removed prior to emptying the container. In a second method an aluminum foil seal is welded over the bottle neck opening and covered with a cap. Here again, the cap must be removed prior to puncturing the seal to open the container. A third method uses an integral bottleneck seal and segmented lid section (frangible) such as illustrated in EP0 0947441 A1 and U.S. Pat. No. 6,213,324.

The above mentioned sealing methods have various disadvantages. Some do not meet the customer requirements of seal integrity, customer handling, recyclability, have a propensity to leak in the event of rough shipping, or are costly in nature because of multiple parts or the need for multiple steps during manufacture.

It is also important to provide a closure assembly that allows for rapid and complete drainage of the contents of the container.

The present invention is directed to overcoming one or more of the problems set forth above.

SUMMARY OF THE INVENTION

In accordance with one aspect of the present invention there is provided a bottle closure assembly for draining a solution contained within a bottle for holding a processing solution, the bottle having a base section, a body portion extending from the base and terminating into a neck portion having an outlet through which the solution may pass, the bottle closure assembly comprising:

a seal secured to the neck portion of the bottle so as to cover the opening such that the seal will retain solution within the bottle; and a cap member for assisting in the rupture of the seal, the cap member having a skirt for securing the cap member to the neck portion.

In accordance with another aspect of the present invention there is provided a bottle and bottle closure assembly for draining a solution contained within a bottle, the bottle closure assembly comprising:

a bottle for holding a processing solution, the bottle having a base section, a body portion extending from the base and terminating into a neck portion having an outlet through which the solution may pass;

a seal secured to the neck portion so as to cover the opening such that the seal will retain solution within the bottle;

a cap member for assisting in the rupture of the seal, the seal having a securing member for securing the cap member to the neck portion.

These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
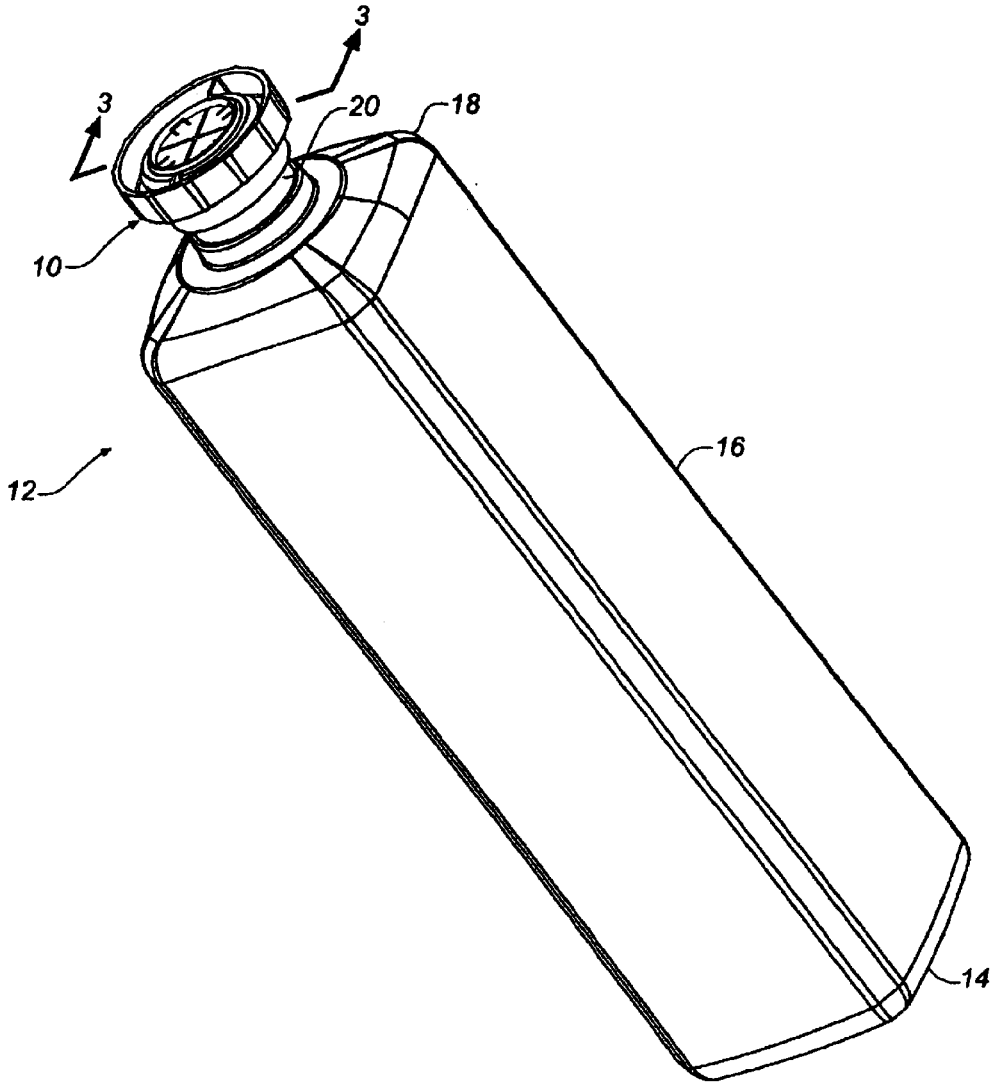
FIG. 1 is perspective view of a bottle and closure assembly made in accordance with the present invention.
Figure 2:
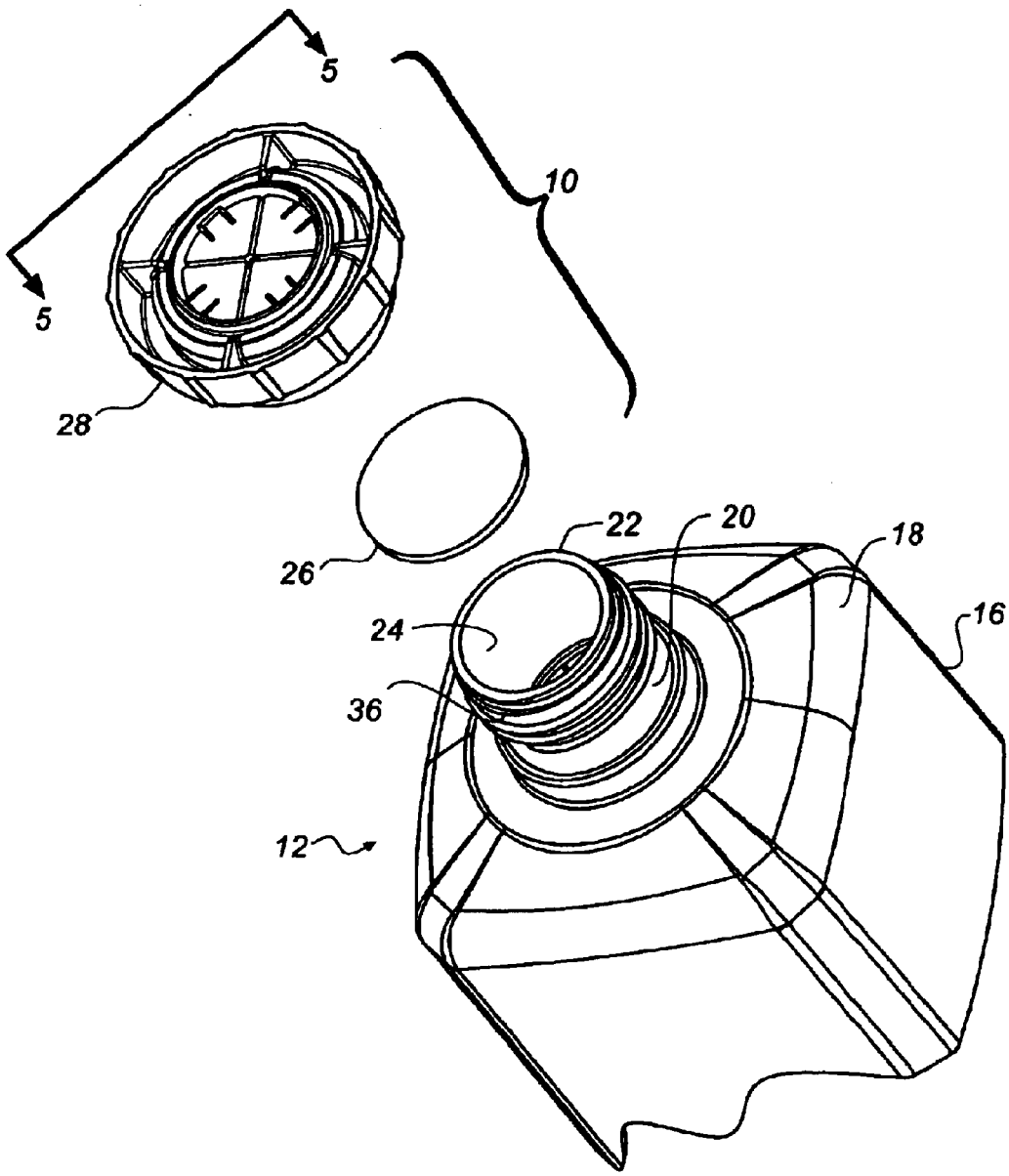
FIG. 2 is a partial exploded perspective view of the bottle and closure assembly of FIG. 1 illustrating the elements of the closure assembly.

Referring to FIGS. 1–8 there is illustrated closure assembly 10 made in accordance with the present invention as provided on a bottle/container 12. The bottle 12 has a base 14, a central section 16 rising up from the base 14, a shoulder section 18 which converges from all sides to form the bottle neck 20. The bottle neck 20 terminates in a rim 22 which defines opening 24 through which solution is provided into or dispensed from bottle 12. In the particular embodiment illustrated the bottle is made of HDPE (high density polyethylene). However, the bottle may be made of any desired plastic or other material so desired.

Figure 6:
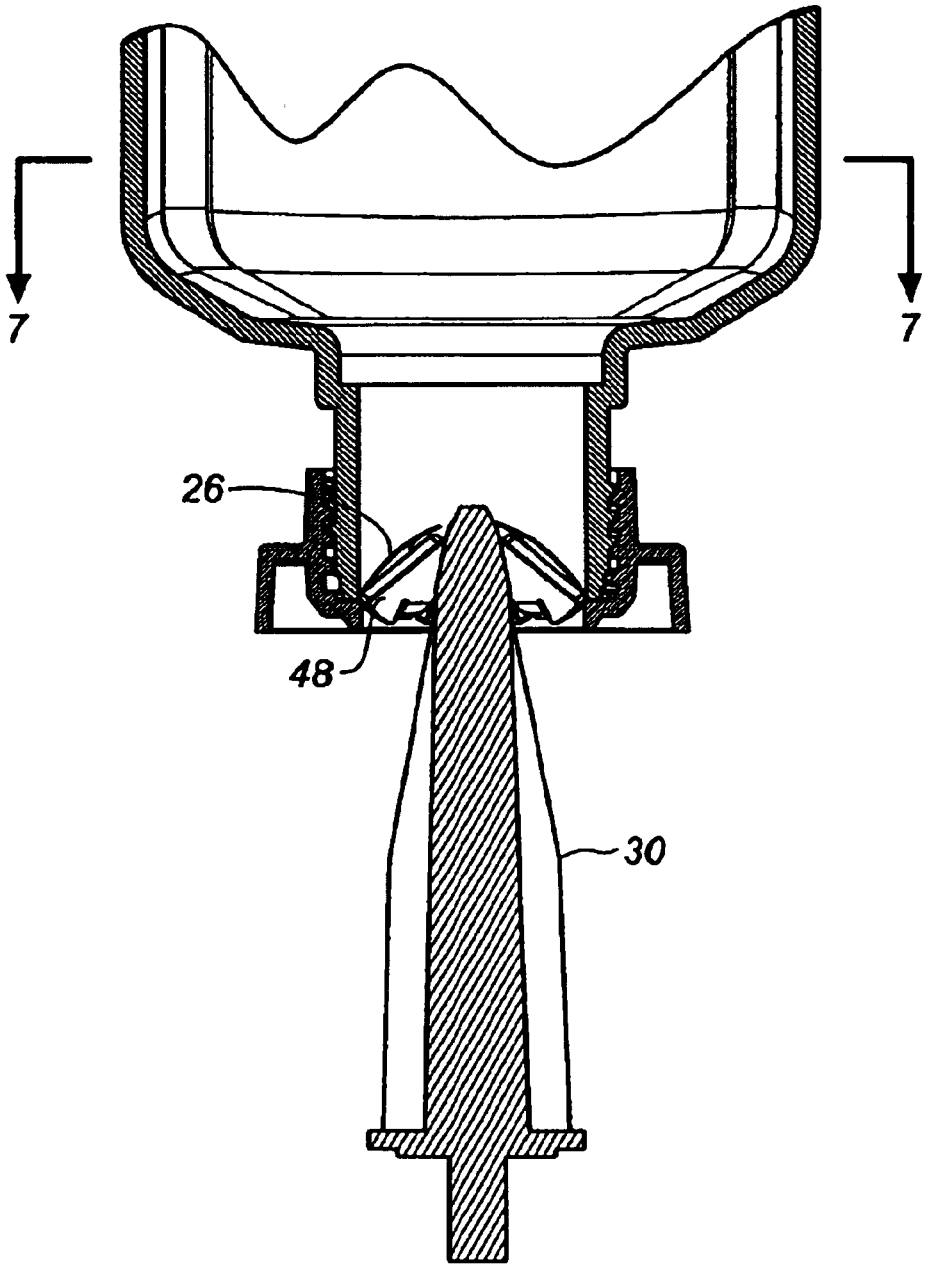
FIG. 6 is a cross sectional view of the neck portion of the bottle and closure assembly illustrating a probe rupturing the closure assembly for opening of the closure assembly.

The closure assembly 10 comprises a seal 26 and cap member 28. The seal 26 is shaped to cover the opening 24 and is secured to rim 22 so as to provide a liquid tight seal so as to prevent accidental spilling or dispensing of the liquid contained within the bottle 12. The seal 26 comprises at least one layer of a material designed such that it can be secured to the material of the rim 22 so as to provide a liquid tight seal with rim 22 of neck 20 and provide the desired break strength. In the embodiment illustrated the seal 26 is made of 3 layers of materials laminated together. The bottom layer is comprised of material formulated to bond with the bottle neck 20 material, usually a polyethylene layer. The other layers provide strength against unplanned rupturing as well as additional barrier properties. These additional layers may be comprised of foil, paper or polymers. The seal 26 function is to contain the liquid in the bottle 12 without leaking and to prevent free exchange of air or moisture, which may degrade the chemicals stored in the bottle12. In the particular embodiment the seal 26 is designed to require a force of less than 20 lbs., for the puncturing of the seal 26 by a puncturing probe 30, as shown in FIG. 6. The probe 30 would typically be provided on the processing apparatus on which the bottle 12 with closure assembly 10 is to be placed for dispensing of the contained solution to the processing apparatus. Preferably the puncture force required to break the seal 26 is less than 15 lbs.

The cap member 28 comprises an annular body 32 from which an annular skirt 34 extends toward bottle 12. The cap member 28 fits over the bottle neck 20 such that that the annular skirt 34 surrounds the upper end 36 of the bottle neck 20. The internal surface 38 of the annular skirt 34 is provided with internal threads 40 for engaging external threads 42 on the outer surface of upper end 36 of said bottle so that the cap member 24 may be secured to the bottle 12. The annular body 32 is provided with an annular surface 44, which defines an opening 46, adjacent the rim 22. The opening 46 has a shape substantially the same as opening 24 in bottle 12. The opening 46 in the embodiment illustrated has a substantially circular shape having a diameter D1 which is equal to or less than the diameter D2 of opening 24. A plurality of rupture members 48 are provided with opening 46 each having an outer hinge member 50 which is attached to the annular surface 44. In the particular embodiment shown there are four rupture members 48. However, any desired number of rupture members 48 may be provided, preferably three to five. The rupture members 48 are shaped so as to provide a narrow space 52 between adjacent rupture members 48. The connecting hinge member 50 are defined by a pair of adjacent hinge slots 56 which serve to increase the overall bending arm of the associated rupture member 48. At the area where the hinge member 50 meets the annular surface 44 there is provided a radius section 58 having a radius R to minimize any stresses as the rupture members 48 are bent during rupture of the closure assembly 10 thereby preventing the rupture members 48 from separating from the annular surface 44. Each rupture member 48 has a thickness T, which is between 0.5 mm and 2.0 mm with a preferable thickness of 0.75 mm to 1.5 mm. The binge slots 56 have a length L of from 0 to ¼D1. The binge slots are preferably ⅓D1 to ⅙D1 in length. The width WH of the hinge slots 56, the narrow space 52 and the circumferential gap 60, the area between the rupture member 48 and adjacent annular surface 44, are all greater than 0 and preferably less than T.

The rupture members 48 are each held in place by the connecting hinge member 50 and a set of connecting ties 54. The ties 54 serve to hold the rupture members 48 to one another, and prevent the rupture members 48 from being moved or displaced prematurely. The connecting ties 54 in the preferred embodiment are shown at the center of the cap member 28, connecting the very tips of rupture members 48. These connecting ties 54 can be located away from center and still serve the same function. The ties 54 have a thickness greater than 0 and equal to or less than the cross sectional thickness T of rupture members 48. The width W (see FIG. 5) of the ties 54 is also greater than 0 and less than T. The preferred dimensions of the ties 54 is set such that a minimal force is required for the puncturing probe 30 to break the ties 54, yet the ties 54 have sufficient resistance to breaking so as to hold the rupture members 48 firmly in position during normal storage and transit prior to dispensing of the contained solution.

Figure 3:
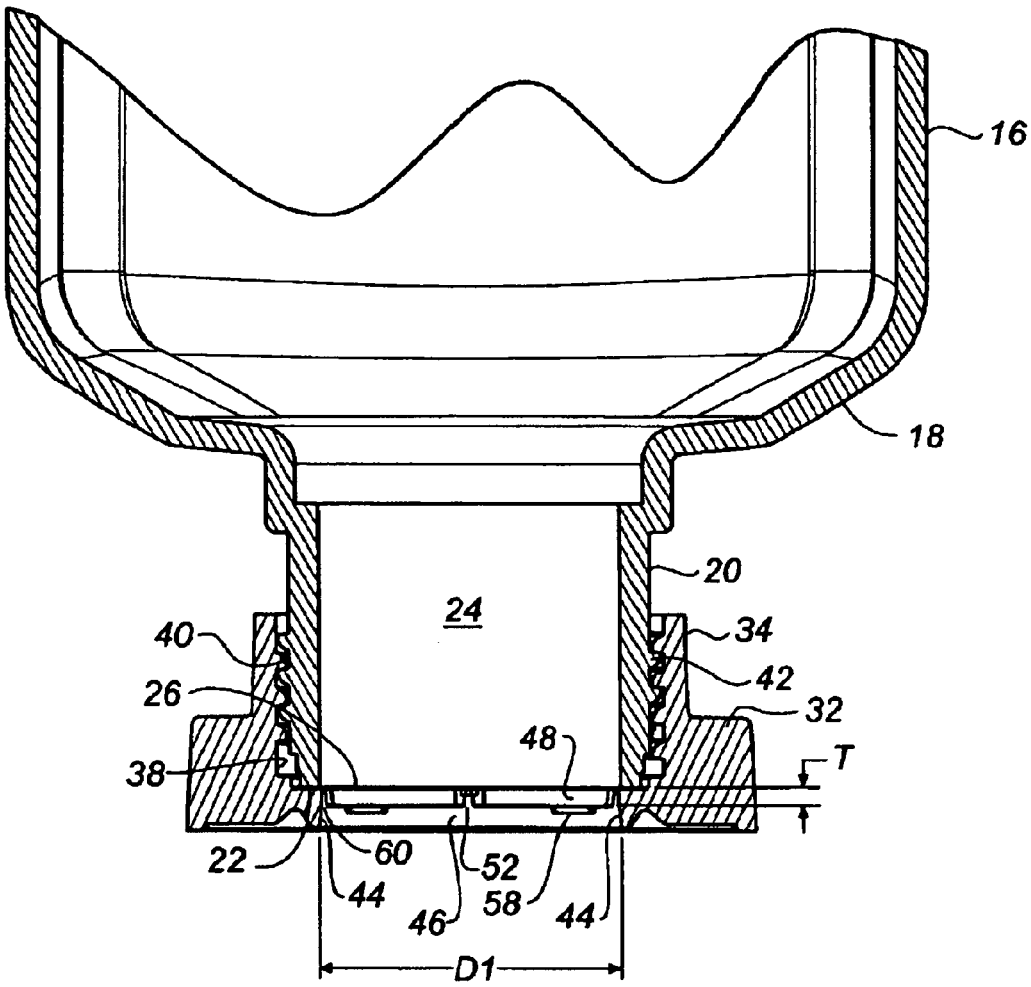
FIG. 3 is a cross sectional view of the bottle and closure assembly in the inverted dispensing position as taken along line 3—3.
Figure 4:
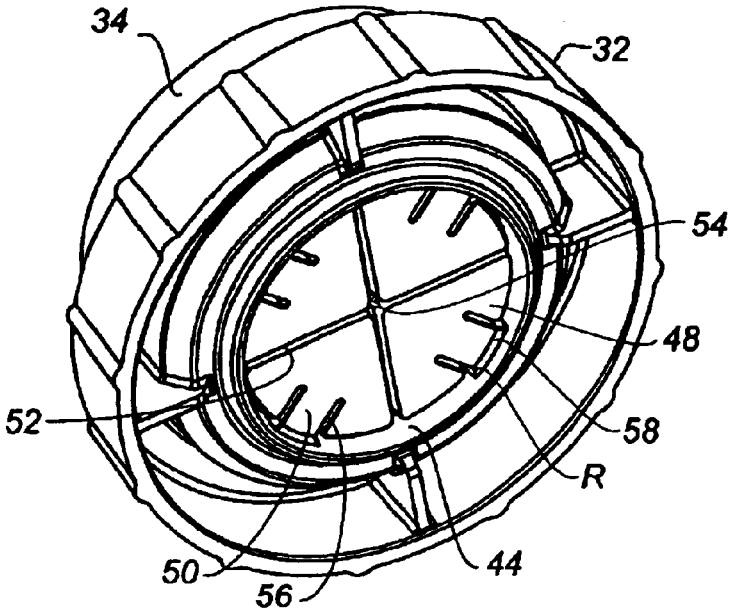
FIG. 4 is an enlarged perspective view of the cap member of the closure assembly illustrated in FIGS. 1–3.
Figure 5:
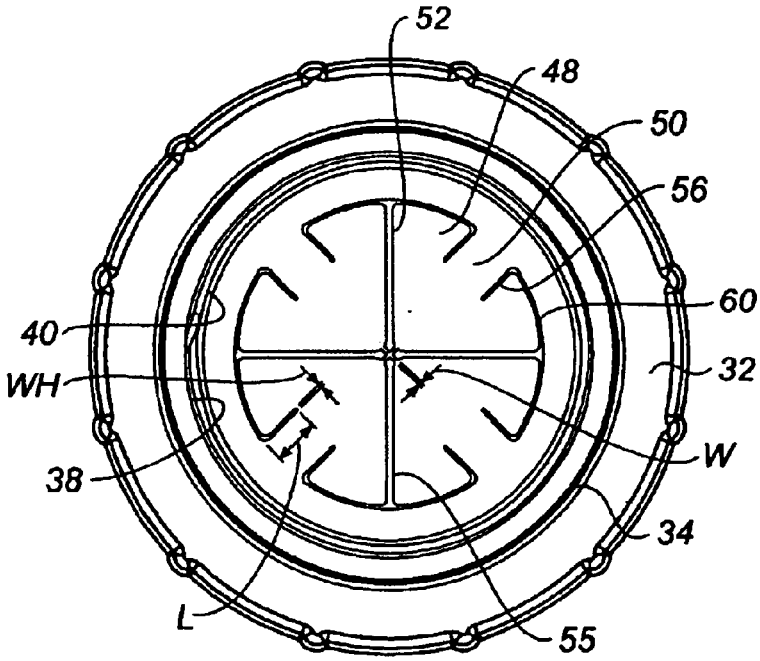
FIG. 5 is plan view of the cap member of FIG. 1 as taken along line 5—5.
Figure 7:
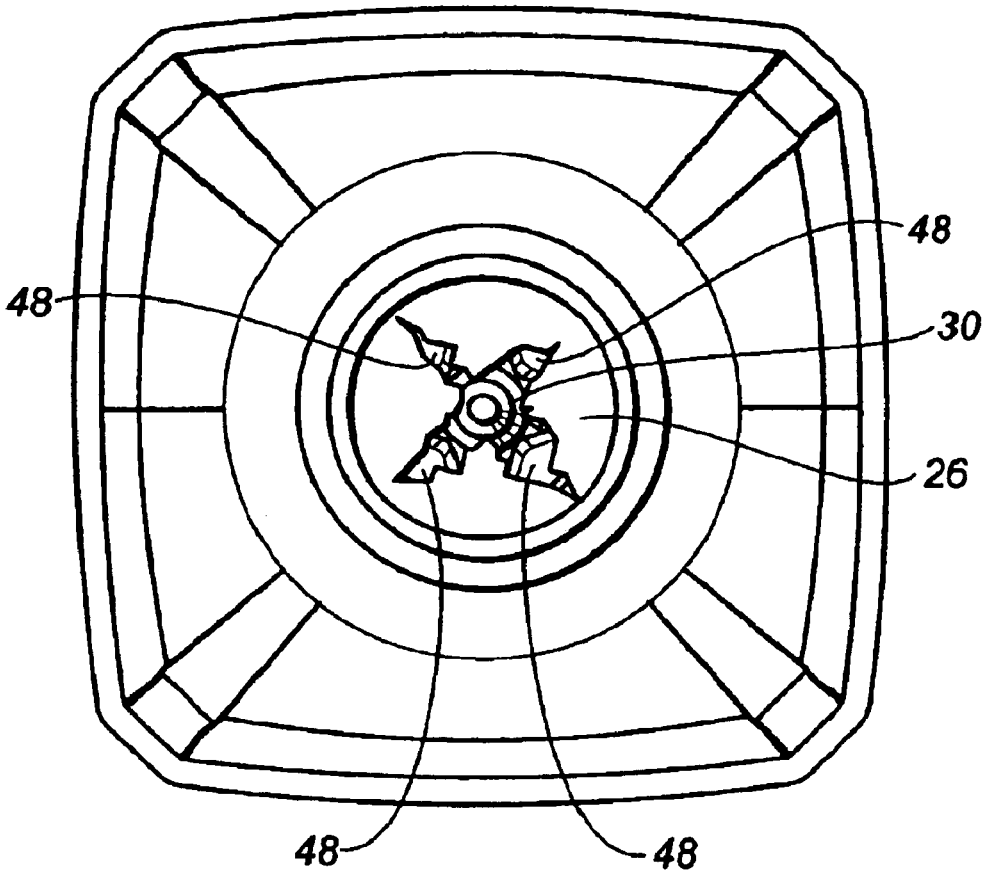
FIG. 7 is cross sectional view of FIG. 6 as taken along line 7—7 illustrating initial penetration of the probe.
Figure 8:
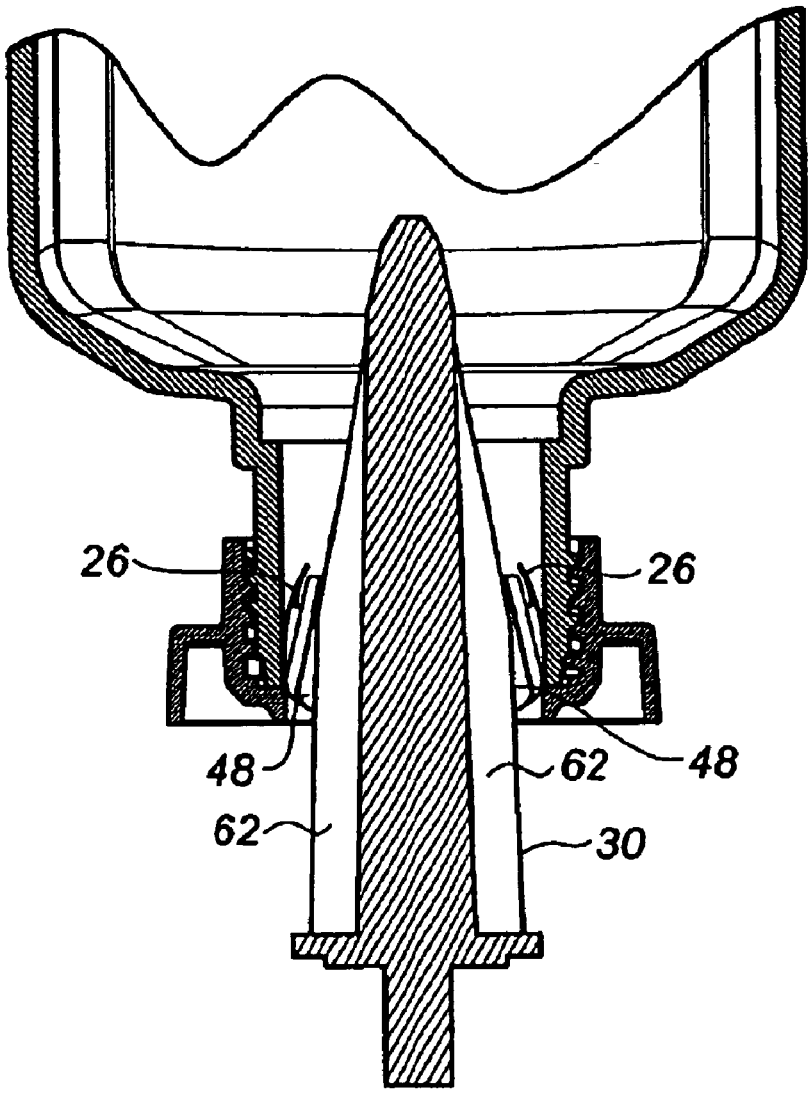
FIG. 8 is a view similar to FIG. 6 illustrating the probe fully engaged position for opening of the closure assembly.

In order to better understand the present invention, a description of the use of the bottle 12 and bottle closure assembly 10 will now be discussed. A bottle 12, or plurality of bottles 12, having the closure assembly 10 and containing an appropriate processing solution is provided. The bottle 12 is placed in the inverted position as shown in FIG. 3. The bottle 12 having the closure assembly 10 is placed in an appropriate device, such a photographic processor, having a rupturing probe 30. The probe 30 is brought into initial engagement with closure assembly 12 as illustrated in FIGS. 6 and 7. As can be seen, there is no need to remove any cap for dispensing of the solution contained in the bottle 12. The probe 30 is placed into the bottle 12 until it is in the fully engaged position as illustrated by FIG. 8. During engagement of the probe 30 with the rupture members 48, the ties 54 are initially broken. As the probe 30 continues into the bottle 12, the rupture members 48 are forced upward about hinge member 50 such that the rupture members 48 are substantially fully rotated (pivoted) about 90 degrees such that the rupture member 48 is moved against the internal surface of the neck 20. As the rupture members 48 move toward seal 26, the edges 55 and probe 30 break the seal 26. The rupture members 48 move the seal toward the neck such that fluid passages 62 are provided adjacent probe 30 to allow the rapid release of the contained fluid from the bottle 12 into a receiving chamber, not shown, in the processing apparatus.

Figure 9A:
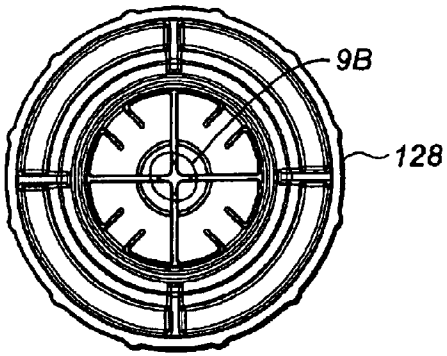
FIG. 9*a* is top plan view of a modified cap member made in accordance with the present invention.
Figure 9B:
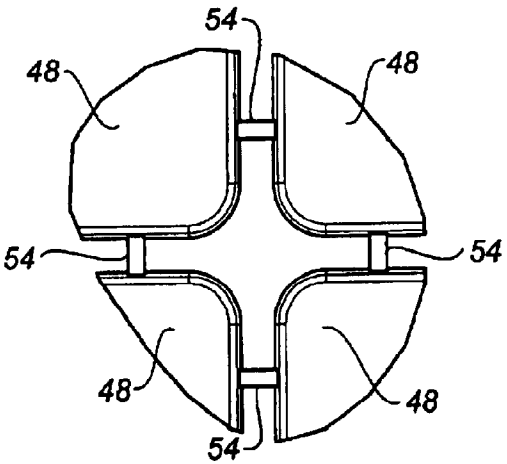
FIG. 9*b* is an enlarged partial view of the center portion of the modified cap of FIG. 9*a;*

It is to be understood that various modifications may be made to the cap member 28 without departing from the present invention. Referring to FIGS. 9*a* and 9*b* there is illustrated a modified cap member 128, identical numerals indicating like parts and operations with respect to cap member 28 as previously discussed. In this embodiment the ties 54 are not placed in the center, but in the space 52 between adjacent rupture members 48.

Figure 10A:
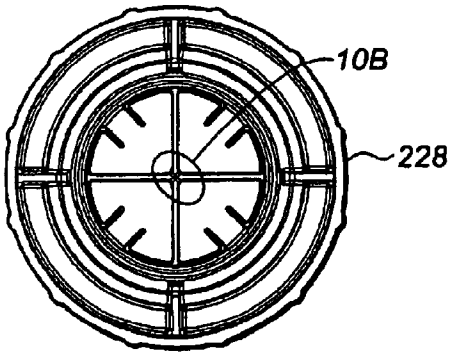
FIG. 10*a* is top plan view of another modified cap member made in accordance with the present invention.
Figure 10B:
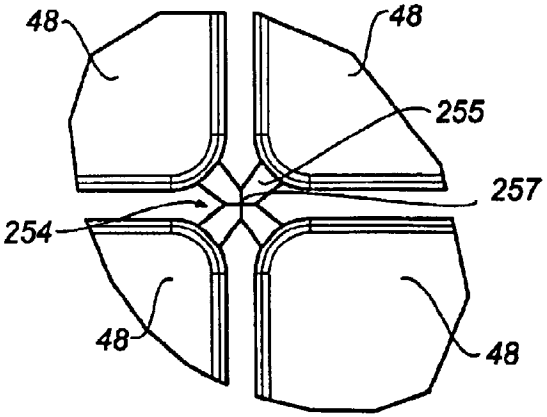
FIG. 10*b* is an enlarged partial view of the center portion of the modified cap member of FIG. 10*a;*

Referring to FIGS. 10*a* and 10*b* there is illustrated another modified cap member 228 made in accordance with the present invention, identical numerals indicating like parts and operations with respect to cap member 28 as previously discussed. In this embodiment the ties 254 are not as thick, have a narrowing section 255 and a break line 257.

Figure 11A:
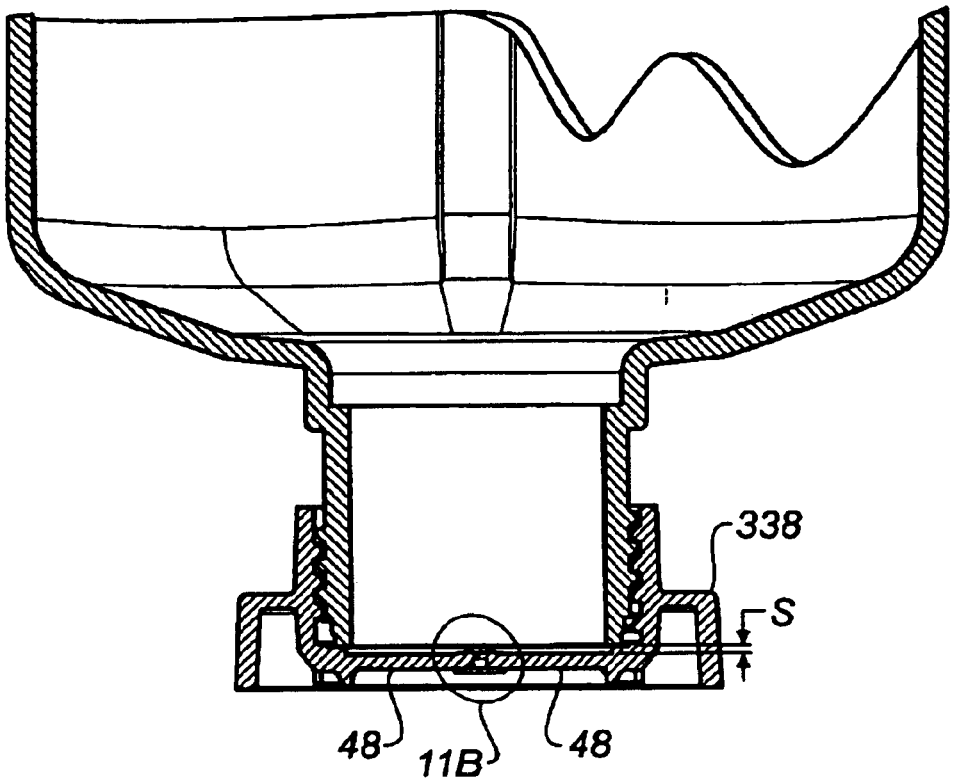
FIG. 11*a* is cross section view similar to FIG. 3 of a modified closure assembly on a bottle made in accordance with the present invention.
Figure 11B:
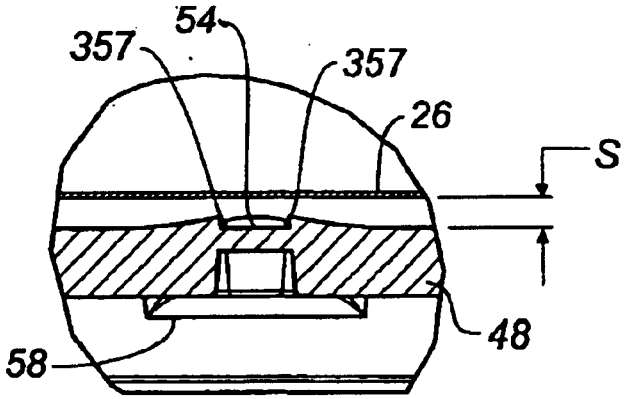
FIG. 11*b* is an enlarged partial view of the rupture members of FIG. 11*a* as identified by the circle 11*b*.

Referring to FIGS. 11*a* and 11*b* there is illustrated yet another modified cap member 338 made in accordance with present invention. In this embodiment the rupture members 48 are spaced a distance S from seal 26. The spacing S provides for a more efficient breaking of the seal 26 by the rupture members 48 by providing a better engagement angle with the seal 26. In addition as illustrated by FIG. 11*b* the edges 55 of the rupture members 48 may be provided with a raised cutting edge 357 to further assist in breaking of the seal 26.

Figure 12:
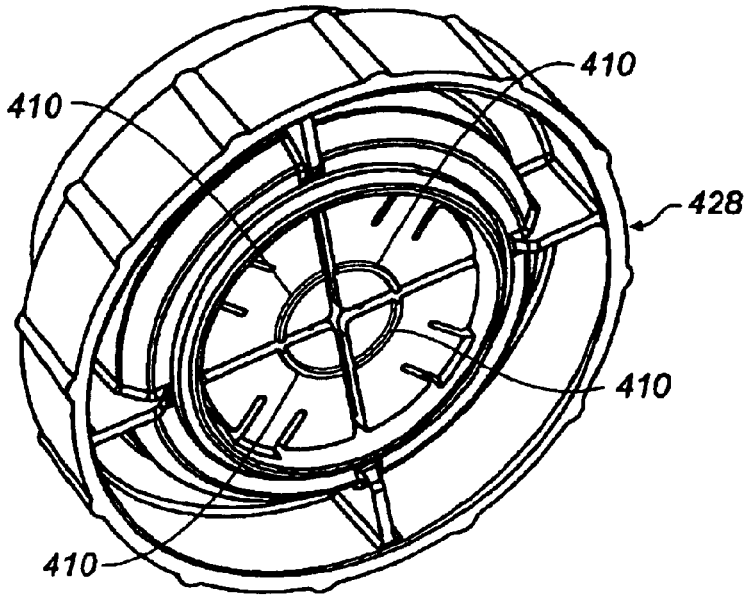
FIGS. 12–15 illustrate various modified cap members made in accordance with the present invention.

Referring to FIG. 12 there is illustrated a perspective view of another modified cap member 428 made in accordance with the present invention, identical numerals indicating like parts and operations with respect to cap member 28 as previously discussed. In this embodiment there is provided a raised rib 410 provided on each of the rupture members 48. The raised ribs engage the outer surface of the probe 30 and have a shape and size designed to assist in forcing the rupture members 48 against the internal surface of neck 20 so as to provide the largest possible fluid passage between the rupture members 48 and probe 30 for rapid dispensing of the contained fluid.

Figure 13:
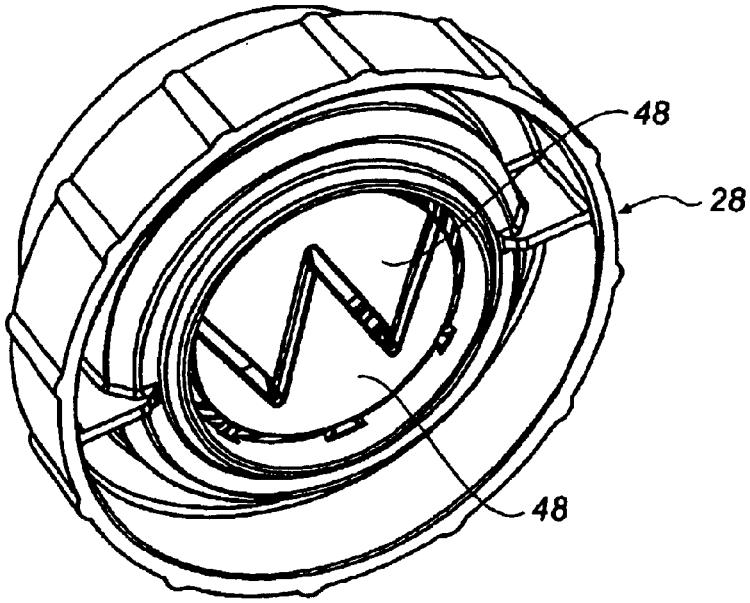
Figure 14:
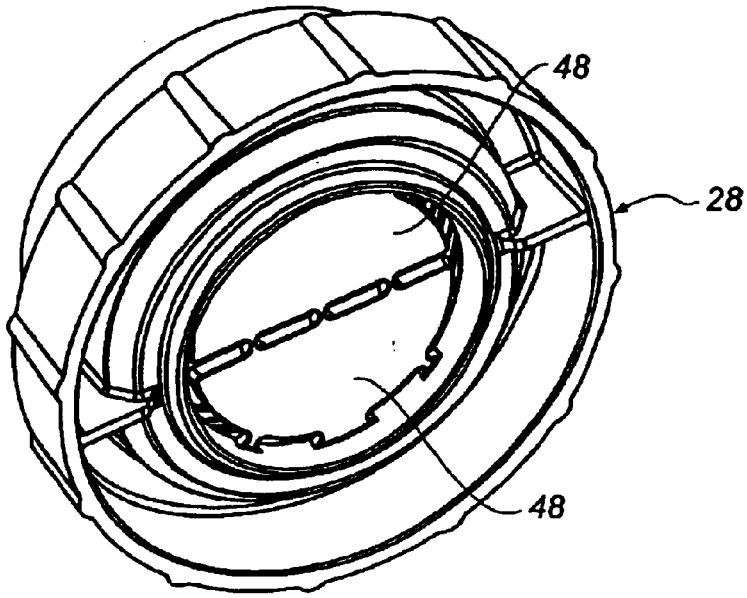
Figure 15:
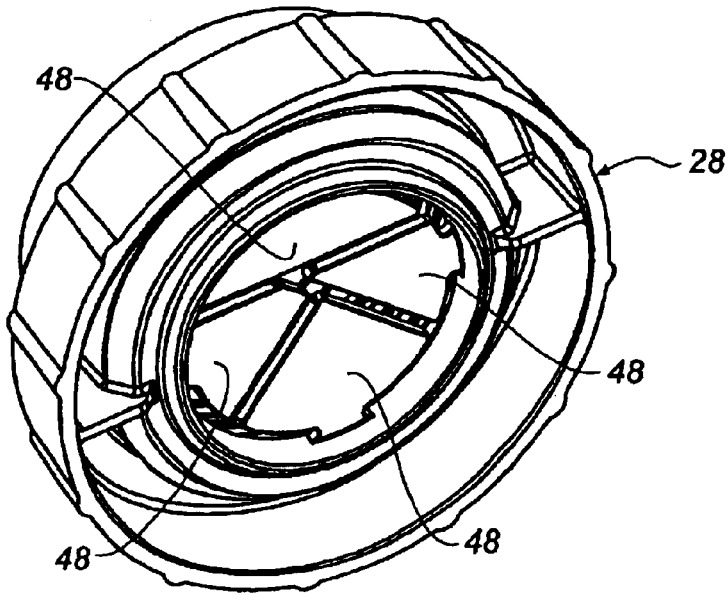

FIGS. 13–15 illustrate various shapes, number and configurations for rupture members 48 in cap member 28.

It is to be understood that various other changes and modifications may be made with out departing from the scope of the present invention, the present invention being defined by the claims that follow.

| PARTS LIST | |
|---|---|
| 3-3 | line |
| 5-5 | line |
| 7-7 | line |
| 10 | closure assembly |
| 12 | bottle/container |
| 14 | base |
| 16 | central section |
| 18 | shoulder section |
| 20 | bottleneck |
| 22 | rim |
| 24 | opening |
| 26 | seal |
| 28 | cap member |
| 30 | puncturing probe |
| 32 | annular skirt |
| 36 | upper end |
| 38 | internal surface |
| 40 | internal threads |
| 42 | external threads |
| 44 | annular surface |
| 46 | opening |
| 48 | rupture members |
| 50 | outer hinge member |
| 52 | narrow space |
| 54 | connecting ties |
| 55 | edges |
| 56 | adjacent hinge slots |
| 58 | radius section |
| 60 | gap |
| 62 | fluid passages |
| 128 | cap member |
| 228 | cap member |
| 254 | ties |
| 255 | narrowing section |
| 257 | break line |
| 338 | cap member |
| 357 | cutting edge |
| 410 | raised rib |
| 428 | modified cap member |

What is claimed is:

1. A cap member for use on a bottle having a sealed member placed over the outlet of the bottle, said cap member having a skirt for securing said cap member to said bottle and a plurality of rupture members that engages said seal upon engagement with an external probe, each of said plurality of rupture members having a shape that will substantially clear said seal at said outlet for allowing quick and easy egress of solution from said bottle while said external probe is present in said bottle and having a connecting hinge that allows said rupture member to pivot approximately 90° with respect to a plane parallel to said outlet.

2. A cap member assembly according to claim 1 wherein said outlet defines a rim, said seal is secured to said rim for preventing liquid from being dispensed from said bottle.

3. A cap member assembly according to claim 1 wherein said bottle has a neck portion having external threads that engage internal threads provided on said cap member.

4. A cap member assembly according to claim 1 wherein said cap member has a body section having internal threads for engaging external threads provided on said bottle.

5. A cap member assembly according to claim 1 wherein said rupture members have a cutting edge for assisting in rupturing said seal.

6. A cap member assembly according to claim 1 wherein said rupture members have a rib for engaging said probe for assisting in moving rupture members against the inside surface of said neck portion.

7. A cap member assembly according to claim 1 wherein at least one tie is provided for securing said rupture members together, said at least one tie being easily broken upon engagement with said probe.

8. A cap member assembly according to claim 1 wherein said rupture members have a thickness in the range of 0.5 mm to 2.0 mm, is made of a material comprising HDPE.

9. A cap member assembly according to claim 8 wherein a hinge radius of the range 0.25 mm to 0.4 mm is formed at the juncture of the connecting hinge and the lateral skirt.

10. A cap member assembly according to claim 9, wherein the connecting hinge is bordered by a hinge slot, the hinge slot having a width greater than 0 and a length greater than 0 and less than or equal to ¼ D1, where D1 is the diameter of the inside circumference of the annular surface of said cap member.

11. A cap member assembly according to claim 1, wherein the rupture members are in contact with the seal when the cap assembly is fully seated on the bottle neck.

12. A cap member assembly according to claim 1, wherein the rupture members are not in contact with the seal when the cap assembly is fully seated, the gap between the seal and the rupture members is greater than 0 inches and equal to or less than T, where T is the thickness of said rupture members.

13. A cap member assembly according to claim 1, wherein a space S between the rupture members is greater than 0 inches and less than T, where T is the thickness of the rupture members.

14. A bottle and bottle closure assembly for draining a solution contained within a bottle, the bottle and bottle closure assembly comprising:

a bottle for holding a processing solution, said bottle having a base section, a body portion extending from said base and terminating into a neck portion having an outlet through which said solution may pass;

a seal secured to said neck portion so as to cover said outlet such that said seal will retain solution Within said bottle;

a cap member for assisting in the rupture of said seal, said cap member having an annular skirt for securing said cap member to said neck portion and a plurality of rupture members that engages said seal upon engagement with an external probe, said plurality of rupture members having a shape that will substantially clear said seal at said outlet for allowing quick and easy egress of solution from said bottle while said external probe is present in said bottle, said plurality of rupture members each having a connecting hinge member that allows said rupture members to pivot approximately 90° with respect to a plane parallel to said outlet.

15. A bottle and bottle closure assembly according to claim 14 wherein said outlet defines a rim, said seal is secured to said run for preventing liquid from being dispensed from said bottle.

16. A bottle and bottle closure assembly according to claim 14 wherein said neck portion has external threads that engage internal threads provided on said annular skirt.

17. A bottle and bottle closure assembly according to claim 14 wherein said cap member has a body section having internal threads for engaging external threads provided on said neck portion.

18. A bottle and bottle closure assembly according to claim 14 wherein said rupture members have a cutting edge for assisting in rupturing said seal.

19. A bottle closure assembly according to claim 14 wherein said rupture members have a rib for engaging said probe for assisting in moving rupture members against the inside surface of said neck portion.

20. A bottle and bottle closure assembly according to claim 14 wherein at least one tie is provided for securing said rupture members together, said at least one tie being easily broken upon engagement with said probe.

21. A bottle and bottle closure assembly according to claim 14 wherein said rupture members have a thickness in the range of 0.5 mm to 2.0 mm, is made of a material comprising HDPE.

22. A bottle and bottle closure assembly according to claim 21 wherein a hinge radius of the range 0.25 mm to 0.4 mm is formed at the juncture of the connecting hinge and the lateral skirt.

23. A bottle and bottle closure assembly according to claim 22, wherein the connecting hinge is bordered by a hinge slot, the hinge slot having a width greater than 0 and a length greater than 0 and less than or equal to ¼ D1, where D1 is the diameter of the inside circumference of the annular surface of said cap member.

24. A bottle and bottle closure assembly according to claim 17, wherein the rupture members are in contact with the seal when the cap assembly is fully seated on the bottle neck.

25. A bottle and bottle closure assembly according to claim 17, wherein the rupture members are not in contact with the seal when the cap assembly is fully seated, the gap between the seal and the rupture members is greater than 0 inches and equal to or less than T, where T is the thickness of said rupture members.

26. A bottle and bottle closure assembly according to claim 17, wherein a space S between the rupture members is greater than 0 inches and less than T, where T is the thickness of the rupture members.

* * * * *

UNITED STATES PATENT AND TRADEMARK OFFICE

CERTIFICATE OF CORRECTION

PATENT NO. : 6,902,076 B2
DATED : June 7, 2005
INVENTOR(S) : Richard W. Bauer et al.

It is certified that error appears in the above-identified patent and that said Letters Patent is hereby corrected as shown below:

Column 7,
Line 12, "run" should be changed to "rim"
Line 24, "A bottle closure" should be changed to "A bottle and bottle closure"

Signed and Sealed this

Ninth Day of August, 2005

JON W. DUDAS
*Director of the United States Patent and Trademark Office*